United States Patent [19]

Dismukes

[11] 4,308,917

[45] Jan. 5, 1982

[54] BUOYANT TUBULARS AND METHOD FOR INSTALLING SAME IN A WELL BORE

[76] Inventor: Newton B. Dismukes, 2952 Buttonwood Dr., Carrollton, Tex. 75006

[21] Appl. No.: 66,673

[22] Filed: Aug. 15, 1979

Related U.S. Application Data

[63] Continuation-in-part of Ser. No. 867,819, Jan. 9, 1978, abandoned.

[51] Int. Cl.[3] ..... E21B 17/00; E21B 19/00

[52] U.S. Cl. ..... 166/381; 166/242

[58] Field of Search ..... 166/72, 77, 242, 248, 166/285, 315; 138/120, 132, 155

[56] References Cited

U.S. PATENT DOCUMENTS

| | | | |
|---|---|---|---|
| 3,055,424 | 9/1962 | Allen | 166/242 X |
| 3,206,537 | 9/1965 | Steward | 166/242 X |
| 3,502,150 | 3/1970 | Dunlap | 166/242 X |
| 3,999,617 | 12/1976 | Ilfrey et al. | 166/362 X |
| 4,024,913 | 5/1977 | Grable | 166/72 |
| 4,046,194 | 9/1977 | Cloud | 166/248 |
| 4,082,144 | 4/1978 | Marquis | 166/77 X |
| 4,086,971 | 5/1978 | Hall et al. | 166/242 X |

*Primary Examiner*—Stephen J. Novosad
*Attorney, Agent, or Firm*—Sidney A. Johnson

[57] ABSTRACT

The invention deals with running and pulling lines and tubulars in a liquid-containing well without use of heavy hoisting equipment. Sections of tubulars somewhat more dense than the well liquid are combined with less dense sections to make up a string which is essentially neutrally buoyant in the liquid. Sections of intermediate density may be included also. Examples of suitable plastic materials are given.

15 Claims, 3 Drawing Figures

BUOYANT TUBULARS AND METHOD FOR INSTALLING SAME IN A WELL BORE

RELATED APPLICATIONS

This application is a continuation-in-part of application Ser. No. 867,819 filed Jan. 9, 1978, now abandoned. It is also related to and useful in practicing the invention disclosed and claimed in application Ser. No. 915,002, filed June 13, 1978 for "Method and Apparatus for Forming Lateral Passageways", now abandoned.

BACKGROUND OF THE INVENTION

During the drilling, completion and operation of oil, gas and water wells many occasions arise when tubular goods or lines must be run into and/or pulled from the bore hole. Usually such tubular goods are made from steel and being much denser than the fluid into which they are run require large and expensive handling equipment. U.S. Pat. No. 4,024,913 to Donovan B. Grable relates to the use of high strength, non-metallic lines and tubulars having a specific gravity less than 2.0 and tensile strengths greater than 185,000 psi.

Also, it is well known in oil and gas drilling operations to float heavy strings of casing into a bore hole to reduce hoisting load. In this operation a lower section of casing is plugged to prevent fluid entry thus providing the required buoyancy. However, the combination of sections of two or more tubular goods or rods having different densities to form a complete string the composite density of which along its length being essentially equal to the density of the well liquid, and thus not requiring the use of heavy hoisting equipment to run into and to take out of a well, appears to be novel.

SUMMARY OF THE INVENTION

The present invention relates to tubular goods and lines, generically designated as "shaft" herein, which may be run into a well bore containing a liquid. The objective is to provide a shaft so nearly precisely neutrally buoyant in the well liquid along its length that as a string is made up it could be moved up or down by hand in a Newtonian liquid. This is achieved by running sections of the shaft more dense than the well liquid and sections less dense than the liquid in such a ratio and order that the combination of shaft densities as the shaft is made up is essentially identical with the average density of the liquid in the bore hole. The bore liquid need not be homogeneous. To compensate for denser liquid, additional higher density shaft sections are incorporated in the string, and vice versa. Tools or devices such as bottom hole pumps, gas lift valves, etc. may be included in the shaft.

Obviously, it would be possible to manufacture a homogeneous shaft having precisely the same density as a given well liquid given enough advance notice and knowledge of the density of the well liquid. From a practical standpoint this is not feasible. Either immense quantities of tubulars would have to be stocked or excessive time spent treating the well liquid to the required density.

The preferred embodiment of the present invention utilizes shaft sections of three different densities. The first shaft sections or joints may have a density of from 2 to 20 percent greater than the well liquid, the second set 2 to 20 percent less dense and the third set would have a density intermediate between the other two sets.

The individual portions or joints may be conveniently of lengths of 25 feet or 30 feet. Where adequate lifting equipment is available, two or three joints may be more or less permanently fixed together to facilitate speed in assembling the total shaft. Short, or pup, joints of 5 or 10 foot lengths may be included for more precise control of shaft density.

As is well known to those skilled in plastics technology, numerous materials are commercially available for forming tubulars and lines for use in practicing my invention, among the most common of which are ABS, polybutylene, polypropylene, polyethylene and polyvinyl chloride. The density in grams per milliliter for unmodified material is: polypropylene, 0.90; polyethylene, 0.96 and polyvinyl chloride 1.36. Less often used as tubing because of its cost, but nevertheless quite readily extruded, is unmodified fluorinated ethylene propylene copolymer known as FEP and available from DuPont. It has a density of 2.15 grams per milliliter.

Many plastic materials may be modified to change their density and improve physical properties. Hollow microspheres, such as Ecospheres available from Emerson and Cuming, Inc., may be used to decrease density while any number of dense powders, such as finely ground barytes, may be added to increase density. Thus, it is quite practical to obtain shaft sections having densities in the range of 0.7 to 3.0 grams per milliliter. The tensile strength and tensile modulus of many plastic substances may be increased by the inclusion of glass or other fibers. One example is a phenylene oxide material known as Noryl PX-0678, available from General Electric Corporation, which when reinforced with 20 to 30 percent glass fibers to attain a density of 1.21 to 1.36 gm./ml. possesses a tensile strength of 14,500 to 17,000 psi and a tensile modulus of about one million. Many other materials also are readily available.

The instant invention is not limited to the use of plastic materials. Light metals such as magnesium and aluminum, or their alloys, may be used.

Those accustomed to the use of steel shafts in bore holes must recognize that the plastic tubulars of the present invention possess some physical properties quite different from steel. If the density of the fluid surrounding the plastic shaft is less than the density of the shaft, the plastic will stretch some 30 or more times as much as steel due to the lower tensile modulus. However, the ratio of tensile strength to density is similar for many reinforced plastic materials and steel. Collapse resistance of the plastic material forming a tube is low, being less than one-third of steel generally. If a considerable length of plastic tubulars is to be suspended in a low density fluid, the upper end should include a pup joint of steel so that the suspending means will not damage the plastic by its tight grip thereon.

The present invention is particularly useful in connection with the methods and means disclosed in my copending application Ser. No. 915,002, filed june 13, 1978, now abandoned. As disclosed therein an auxilliary tube is used to guide a boring means into contact with earth strata when forming a lateral passageway from a vertical well bore. The principal or vertical well usually is filled with a drilling fluid. Often it may have been drilled and completed long before the lateral drilling operation was considered and therefore no drilling or hoisting equipment is on site. Since the lateral boring itself may not require a rig, a rig would be needed only to run and pull the auxiliary tubing. Thus, the use of the herein described buoyant tubulars obviates the need for a rig for forming lateral passageways.

The sections of tubular goods or rods may be joined together in various ways depending upon the use intended. Electromagnetic bonding may be used for more or less permanent connections. To assemble a composite shaft of sections of varying densities a bell and spigot type of coupling aided by a j-slot and an O-ring seal, or a simple threaded joint may be used. In general practice each section from the lowermost through the next to the topmost will consist of a plurality of individual joints of rod or tubular goods. The section may be made up by joining the individual joints together or they may be joined as doubles or thribbles where light hoisting equipment is available to stand up and hold such lengths. A single steel joint may comprise the topmost section, frequently adding sufficient weight of high density material, i.e., 7 to 8 grams per milliliter to attain the final desired small negative buoyancy of the total shaft.

In an actual field operation it is not necessary to know the well fluid density accurately throughout the entire well. One should know the approximate average density to such an extent that one has on hand shaft sections of different densities, some of which are greater in density than the well fluids and some are less. Generally the first shaft section run would have an average density greater than the well fluid so that the lowermost end of the shaft would have less tendency to deviate against the side of the hole. This does not mean that one or more lengths of tubular goods in the first section may not be of lower density so long as the average density of the section is greater. For example, one may wish to run a low density, highly porous screen at or closely adjacent the bottom end.

In the upper end of the first shaft section, a second shaft section having a density less than the well fluid would be attached. Normally, joints of lower density material would be made up and added until the upper end of the total shaft floated above the casing head to such an extent that the addition of further joints was becoming difficult of accomplishment. At such time joints of higher density would be added. Thereafter, one would run a tubing section having a higher density if too much of the string floated above the casing head, or a lower density section if the string tended to sink too much. During the time that a string of tubulars is being run into a bore it generally is preferred to maintain a slight positive buoyancy, enough so that a few feet of tubing will remain above the top of the casing to facilitate handling and to prevent the tubing string from falling to bottom if in an unrestrained condition. However, by the time the final section is run it is preferred to have a negative tubing buoyancy to keep the top section seated in the casing head.

PREFERRED EMBODIMENT

Figure 1:
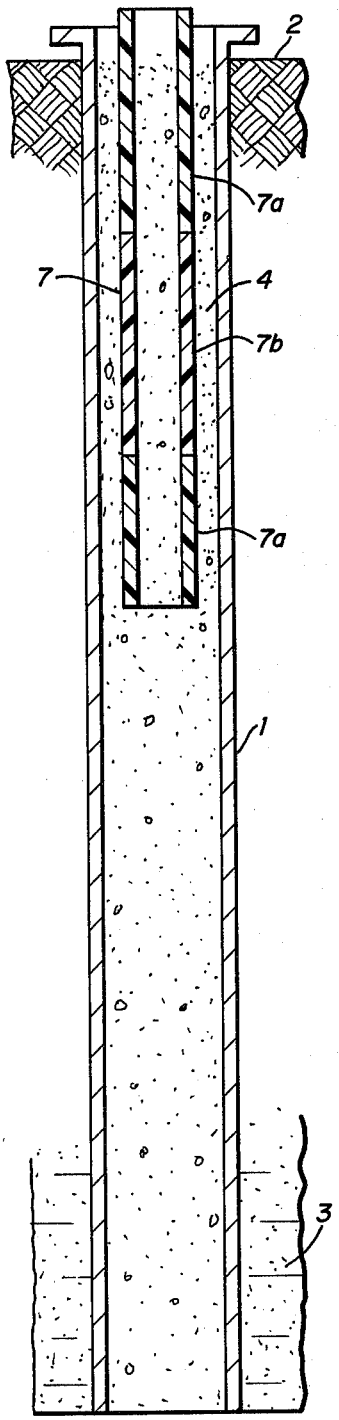
FIGS. 1, 2 and 3 are partly schematic cross sectional views of a string of tubulars having sections of different densities at different stages of being run into a well.
Figure 2:
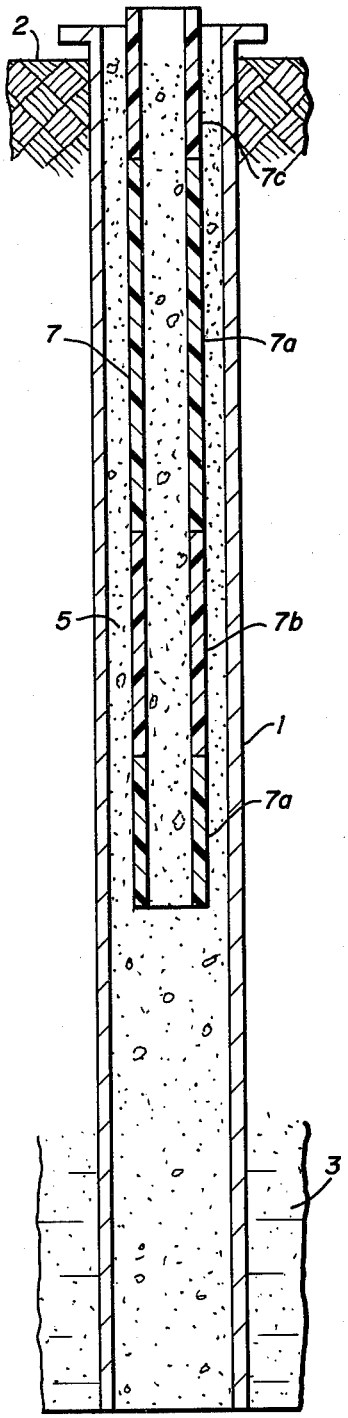
Figure 3:
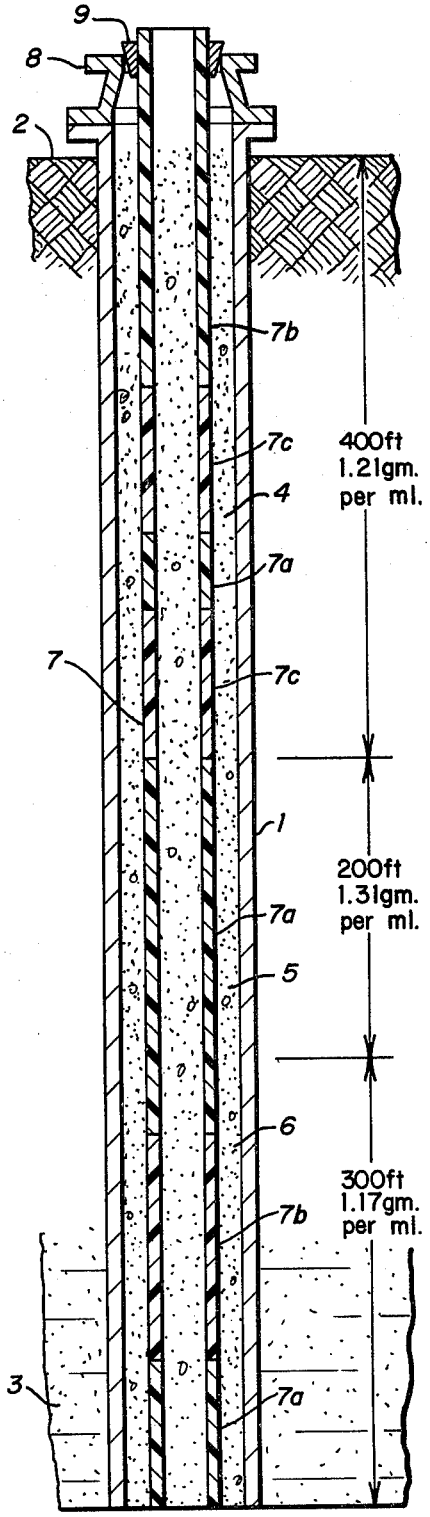

The preferred embodiment of the instant invention is most readily explained by referring to FIGS. 1, 2 and 3 wherein like elements are designated by the same reference characters. Cased bore hole 1 extends from the surface of the earth 2 to strata 3. Bore hole 1 is filled with drilling fluids 4, 5, and 6 having densities of 1.21, 1.31 and 1.17 grams per milliliter respectively in the intervals 0–400, 400–600 and 600–900 feet as shown on the right hand side of FIG. 3. In this example, it is desired to run a string of tubing to 900 feet without using hoisting equipment. Available are 10-foot lengths of tubing 7 with tubing *7a* having a density of 1.24, tubing *7b* 1.14 and tubing *7c* 1.33 grams per milliliter. These tubings weigh in air 3.00, 2.76 and 3.22 pounds per foot, respectively. Pup joints 5 feet long of each density also are on hand. In the present example a final negative buoyancy of 30 pounds is desired.

To more clearly explain the present invention, buoyancy is calculated below for several depths during the running of the tubulars.

| Length Tubular Inserted, Feet Interval (Cumulative) | Weight Tubular Inserted, Lbs. Interval (Cumulative) | Fluid Wt. To Be Displaced, Lbs. Interval (Cumulative) | Buoyancy Differen, Lbs. Interval (Cumulative) |
|---|---|---|---|
| 100a | 300 | 293 | −7 |
| (100) | (300) | (293) | (−7) |
| 150b | 414 | 440 | 26 |
| (250) | (714) | (733) | (19) |
| 150a | 450 | 440 | −10 |
| (400) | (1164) | (1173) | (9) |
| 100a | 300a | 310 | 10 |
| (500) | (1464) | (1483) | (19) |
| 100c | 322 | 309 | −13 |
| (600) | (1786) | (1792) | (6) |
| 50a | 150 | 142 | −8 |
| (650) | (1936) | (1934) | (−2) |
| 100c | 322 | 283 | −39 |
| (750) | (2258) | (2217) | (−41) |
| 150b | 414 | 425 | 11 |
| (900) | (2672) | (2642) | (−30) |

Results of the above calculations show that after the first 100 feet of tubing *7a* were run into bore casing 1 through drilling fluid 4, a negative tubing buoyancy of 7 pounds existed. To reduce this negative buoyancy, 15 joints, 150 feet, of tubing *7b* were run, resulting in a net positive buoyancy of 19 pounds. After an additional 150 feet of tubing *7a* was run, the positive buoyancy was reduced to 9 pounds. A further 100 feet of tubing *7a* and then 150 feet of tubing *7c* were run reducing the net positive buoyancy to 6 pounds after running the first 600 feet to tubing. To reach a depth of 900 feet with a negative buoyancy of 30 pounds, 50 feet of tubing *7a*, 100 feet of tubing *7c* and 150 feet of tubing *7b* were run. Then casing head 8 is fixed to casing 1. Next slips 9, shown schematically, are set around the top section of tubing 7 to prevent tubing 7 from falling to the bottom of cased bore 1 by seating in the casing head 8.

While the foregoing description has dealt with certain specific embodiments to illustrate the materials used and the method of practicing my invention, it is to be understood that other embodiments may be used and practiced without departing from the spirit of the invention. Various modifications and substitutions of materials will suggest themselves to those skilled in the art.

I claim:

1. The method of installing an elongated shaft member in a well bore substantially filled with a liquid comprising the steps of:

(a) inserting into said well bore liquid a first shaft section having a density greater than the density of the liquid into which such shaft section is inserted;

(b) while supporting said first shaft section, joining to the upper end thereof a second shaft section having a density less than the density of the liquid into which such shaft is introduced;

(c) lowering said first and second shaft sections into said liquid;

(d) adding stepwise additional shaft sections to attain the desired shaft length, each shaft section added through the penultimate section being selected so as to have a density either greater or less than the density of the liquid in the well bore such that the average density of all of the sections already in the well bore plus the section being added is slightly less than the average density of the well bore liquid whereby the upper end of the shaft as it is being formed remains slightly above the surface of the liquid in the well.

2. The method of claim 1 wherein the density of the first shaft section is from 2 to 20 percent greater than the density of the liquid.

3. The method of claim 1 wherein the density of the final section at the top end of the shaft is greater than the average density of the liquid in the well bore and its total weight is sufficient to give the total shaft a slight negative buoyancy.

4. The method of claim 1 wherein the density of the higher density sections is from 2% to 20% greater than the average density of the liquid in the well bore and the density of the lower density sections is from 2% to 20% less than the average density of the liquid in the well bore.

5. The method of claim 1 wherein each shaft section added through the penultimate section consists of a plurality of individual joints.

6. An elongated shaft in a liquid filled well bore said shaft comprising:

(a) a lowermost first section having an average density greater than the average density of well bore liquid;

(b) a second section affixed to said first section having an average density less than the average density of the well bore liquid, the volume of liquid displaced by said first and second section being less than the total volume of said sections;

(c) additional sections, the first of which additional sections is affixed to the upper end of said second section and the remainder of which additional sections are sequentially affixed to each other with the first additional section having an average density greater than the average density of the well bore liquid and thereafter each section alternately having an average density less than the average density of the well bore liquid and an average density greater than the average density of the well bore liquid so that at any point along the length of said shaft from the bottom to the upper end of the penultimate section, such shaft segment would have positive buoyancy with respect to the liquid in the well.

7. The elongated shaft of claim 6 in which the shaft sections have at least three different densities, one of which is from 2% to 20% greater than the average density of the well liquid, and another of which is from 2% to 20% less than the average density of the well liquid.

8. The elongated shaft of claim 7 in which the density of at least some of the shaft sections is intermediate the densities of the densities of the shaft sections specified in claim 7.

9. The elongated shaft of claim 6 wherein the topmost section has a density greater than the well bore liquid and has sufficient weight to give the total shaft a negative buoyancy with respect to the liquid in the well.

10. The elongated shaft of claim 6 wherein at least some of the sections comprise a plurality of individual joints having substantially identical average densities.

11. An elongated shaft in a liquid filled well bore comprising at least four sections some of which are less dense than the well liquid and some of which are more dense than the well liquid, said sections being joined in alternate end to end relationship and being of such lengths as to constitute a shaft having an average density substantially equal to the average density of the well bore liquid so as to render said shaft substantially neutrally buoyant therein.

12. The elongated shaft of claim 11 wherein the topmost and the bottommost sections have densities greater than the density of the well bore liquid.

13. The method of installing an elongated shaft member in a well bore substantially filled with liquid, said shaft member comprising individual sections some of which have a density greater than the density of the well liquid and some of which have a density less than the well liquid, said method comprising the steps of:

(a) inserting into said well bore a first shaft section;

(b) while positioning the upper end of said first shaft section above the level of the liquid in the well, joining to the upper end thereof a second shaft section having a density different than the density of the first shaft section, one of said shaft sections being more dense and the other less dense than the average density of the well liquid displaced and the lengths of said sections being so selected that the average density of the combined sections is slightly less than the average density of the well liquid displaced; and (c) joining to the upper end of the second shaft section a third shaft section having a density different than said second shaft section.

14. The method of claim 13 wherein the density of the third shaft section is the same as the density of the first shaft section.

15. The method of claim 13 wherein the density of the third shaft section is intermediate the density of the first and the second shaft sections.

* * * * *